US011663873B2

(12) United States Patent
Ackermann

(10) Patent No.: US 11,663,873 B2
(45) Date of Patent: May 30, 2023

(54) BUSINESS METHOD FOR A FINANCIAL INSTRUMENTS LOTTERY IMPLEMENTED IN SOFTWARE OR HARDWARE

(71) Applicant: Heiko Ackermann, Rietheim-Weilheim (DE)

(72) Inventor: Heiko Ackermann, Rietheim-Weilheim (DE)

( * ) Notice: Subject to any disclaimer, the term of this patent is extended or adjusted under 35 U.S.C. 154(b) by 0 days.

(21) Appl. No.: 17/132,669

(22) Filed: Dec. 23, 2020

(65) Prior Publication Data

US 2022/0198866 A1 Jun. 23, 2022

(51) Int. Cl.
*A63F 9/24* (2006.01)
*G07C 15/00* (2006.01)

(52) U.S. Cl.
CPC ..... *G07C 15/005* (2013.01); *G07C 15/006* (2013.01)

(58) Field of Classification Search
None
See application file for complete search history.

(56) References Cited

U.S. PATENT DOCUMENTS 6,484,151 B1 * 11/2002 O'Shaughnessy ..... G06Q 40/06 705/36 R
6,709,330 B1 * 3/2004 Klein ..... G06Q 40/06 463/9
7,158,951 B2 * 1/2007 Stark ..... G06Q 40/00 705/37
7,566,270 B2 * 7/2009 Amaitis ..... G07F 17/32 463/16
7,693,781 B2 * 4/2010 Asher ..... G06Q 40/025 463/16
7,870,059 B2 * 1/2011 Shapiro ..... G06Q 40/00 705/37
7,882,013 B2 * 2/2011 Shapiro ..... G06F 3/04847 705/37
8,108,299 B1 * 1/2012 Waelbroeck ..... G06Q 40/025 705/37
8,535,140 B2 * 9/2013 Alderucci ..... G07F 17/3288 463/16
2001/0027438 A1 * 10/2001 Park ..... G06Q 40/04 705/37
2002/0128950 A1 * 9/2002 Wu ..... G06Q 40/04 705/37
2005/0208996 A1 * 9/2005 Friedman ..... G07F 17/3255 463/16
2006/0079311 A1 * 4/2006 Nulph ..... G06Q 50/34 463/17
2008/0254852 A1 * 10/2008 Wright ..... G07F 17/32 463/17
2010/0222125 A1 * 9/2010 Nyman ..... G07F 17/329 463/25
2016/0012465 A1 * 1/2016 Sharp ..... G06Q 20/321 705/14.17

* cited by examiner

*Primary Examiner* — Sunit Pandya

(57) ABSTRACT

The disclosure describes a software-implemented method for an easy-to-use interface for processing financial transactions. Described is a graphical user interface having the look-and-feel of a lottery ticket. Additionally, the way this user interface is used to create a list of financial transactions and their sequentially processing by a computer is defined.

2 Claims, 10 Drawing Sheets

Fig 3 A
204
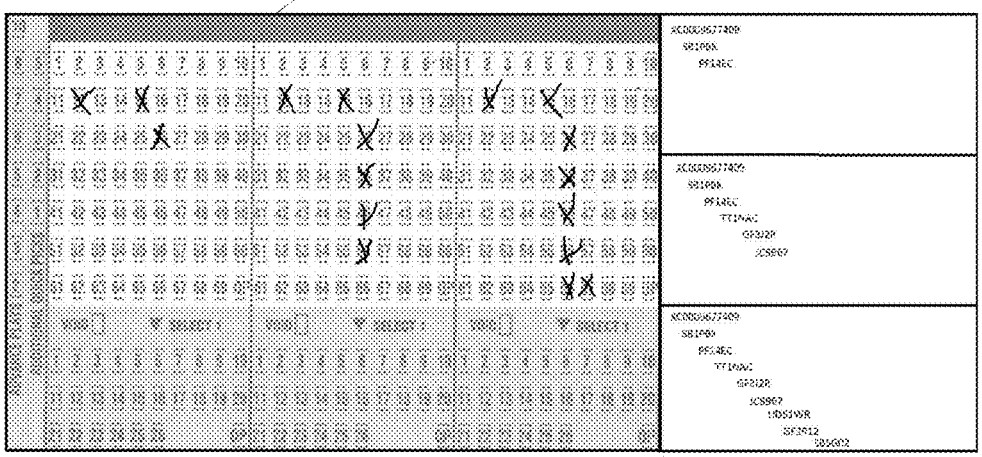
Fig 3 B
300
| | | | | |
|---|---|---|---|---|
| 1 XC00 | 2 XC00 | 3 XC00 | 4 XC00 | 5 XC00 |
| 5 XC00 | 6 XC00 | 7 XC00 | 8 XC00 | 9 XC00 |
| 10 XC00 | 11 XC00 | 12 XC00 | 13 XC00 | 14 XC00 |
| 15 XC00 | 16 XC00 | 17 XC00 | 18 XC00 | 19 XC00 |
| 20 XC00 | 21 XC00 | 22 XC00 | 23 XC00 | 24 XC00 |
| 25 XC00 | 26 XC00 | 27 XC00 | 28 XC00 | 29 XC00 |
302
Fig 3 C
| | | | | |
|---|---|---|---|---|
| XCOO | XCO1 | XCO2 | XCO3 | XCO4 |
| XCO6 | XCO7 | XCO8 | XCO9 | XCO10 |
304
Fig 3 D
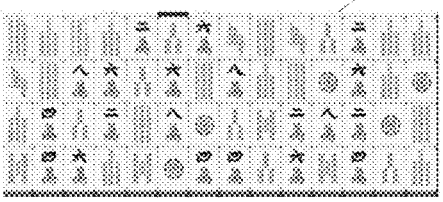
Fig 3 E
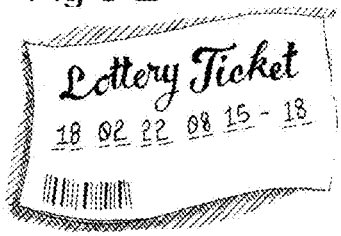
308

400

| 1 | 2 | 3 | 4 | 5 | 6 | 7 |
|---|---|---|---|---|---|---|
| A | B | C | D | E | F | G |

402

A 1 d ► B 1 d ► C 2 d ► D 10h ► E 1d ► F 1d ► G

| 1 | 2 | 3 | 4 | 5 | 6 | 7 | F |
|---|---|---|---|---|---|---|---|
| 10 | 5 | 15 | 45 | 250 | 1024 | 2045 | 4090 |

406

BUSINESS METHOD FOR A FINANCIAL INSTRUMENTS LOTTERY IMPLEMENTED IN SOFTWARE OR HARDWARE

CROSS-REFERENCE TO RELATED APPLICATIONS

Not Applicable

FEDERALLY SPONSORED RESEARCH

Not Applicable

SEQUENCE LISTING OR PROGRAM

Not Applicable

TECHNICAL FIELD

The technical field is the financial technology sector. It describes a whole concept for an easy-to-use interface to trade financial products. The look-and-feel could be like a lottery. A lottery is a special type of gambling that lets the customers pick a selection of numbers out of a given field of numbers. Later a selection of numbers is picked randomly—everybody who has chosen the same numbers has won. Instead of numbers, symbols, words or other items may be used. Many governments do regulate private lottery games in different ways. This is related to the fact that governments know, A lottery is a special type of gambling that lets the customers pick a selection of numbers out of a given field of numbers. Later a selection of numbers is picked randomly—everybody who has chosen the same numbers has won. Instead of numbers, symbols, words or other items may be used. Many governments do regulate private lottery games in different ways. This is related to the fact that governments know, that lottery games are very popular and could generate a lot of revenue for the governments. Lottery games are often played by its customers for fun on the one hand or to win money with the big hope to get rich on the other hand.

Another industry which is largely (and all over the world) used to generate money is the Financial Industry. The Financial Industry is a major and important part of the economy. It is relayed on financial services which covers a wide range of businesses sectors that manage money including credit unions, banks, credit-card companies, insurance companies, accountancy companies and so on. The whole sector is mainly based of financial instruments—these are monetary contracts between (at least) two parties. Therefore, they can be created (as a mix of different other contracts), traded and modified (re-structured). They can be cash (for example a currency), proof of an ownership (share), interest in an entity or a contractual right to receive or deliver material or immaterial goods (e.g. currency; debt, bonds; loans; Equity: shares; Derivatives: options, futures, forwards). In the International Accounting Standards (IAS 32 and 39), financial instruments are defined as "any contract that gives rise to a financial asset of one entity and a financial liability or equity instrument of another entity. Types of financial instruments can be separated into securities, other cash (instruments whose value is determined directly by the markets), exchange-traded derivatives and over the counter (OTC) derivatives (an OTC derivative is a financial contract that does not trade on an asset exchange and can be customized to the need of each demanding party). Derivatives are instruments which derive their value from the value and characteristics of one or more underlining entities such as an asset, index or interest rate). They can also be separated into asset classes such as debt (long term/short term), equity and foreign exchange. Typical examples of financial instruments are Bonds, Loans, Bond futures, Options on bond futures, Interest rate swaps, Interest rate caps and floors, exotic derivatives, Forward rate agreements, stock options, foreign exchange options, outright forwards, currency futures, short term interest futures, stock, deposits, certificates of deposit, repurchase agreements. In terms of trading volume, the foreign exchange (Forex, Fx or currency market) is by far the largest market in the world. In this global decentralized (or OTC) market for trading foreign currencies, exchange rates for every currency are determined. The major player in these markets are financial institutions which operate on several levels. Due to the fact, that most of the merchants are banks which trade large quantities of foreign exchange which is done OTC—this is called the interbank market. The foreign exchange market is very large and operates continuously (24/7). By using leverage, it is easy to speculate with very large amounts of money (and the possibility to win or lose those large amounts). Speculating with high risk is also possible with other financial instruments like binary options, derivatives, knock-out options, turbos etc.

Another very important task of the financial industry is the financial transaction. Financial transactions are defined as an agreement between a buyer and seller to exchange an asset for a payment. There are levels of access to these markets: a standard retail customer has no opportunity to use low-cost and high-risk financial instruments because he has no access to these levels—even if they want to use these financial instruments only in order to speculate or for fun—instead of doing long-term investments.

This invention solves this problem.

BACKGROUND OF THE INVENTION—OBJECTS AND ADVANTAGES

FIG. 1 shows a simplified schematic of the interaction between a retail customer and a retail broker. A retail broker (102) is a company which addresses individual customers other than large institutions. A retail customer (100) is an individual. The retail customer (100) is able to sell or buy financial products using a retail broker (102) like stocks, options, derivatives or other tradeable financial instruments. The retail broker (102) has a higher access level to the financial industry and is able to process the order of its customer (100) at an exchange (104) or any other market maker (106). The broker has also access to automated trading systems (ATS—108) or other large, institutional brokers (110). The schematic is divided into two overlapping areas (112) and (114). Section 114 addresses the interaction between customer and broker while section 112 addresses the interaction of the broker with the financial markets/industry. In the customer/broker-interaction section (114), all interactions between the retail customer (100) and the retail broker (102) are processed. The broker/financial markets/industry-interaction section (112) addresses the processing of the order by the retail broker (102) by other financial institutions. The customer/broker-interaction section (114) is the focus of this invention.

SUMMARY

The invention consists mainly on the business method described hereafter: a retail customer is able to choose financial instruments out of a graphical interface. This could be a simple list in which numbers are selected, but the instruments could also be chosen by selection symbols, pictures or words. The chosen financial instruments will be sequentially (or parallelly) processed by a retail broker. The money of the customer will be used to buy the first financial instrument. After a specified time (most likely a day) the first financial instrument will be sold automatically and the next financial instrument will be bought. This step will be repeated until the list (of all selected financial instruments) is finished or no more money is left (if the prior financial bets made loss). If high risk financial instruments will be used, the customer has to be protected so that he can only loose the amount of money he had invested (due to financial regulations). But if the customers have chosen the right financial instruments and want to take a high risk, they can make a lot of money which is similar to a lottery—but the chance to win is way higher. In this business model, the retail broker takes a small percentage of provisions in order to pay the financial institutions, to do marketing and to pay the salaries.

BRIEF DESCRIPTION OF THE SEVERAL VIEWS OF THE DRAWING

FIG. 3A-E show five different types of customer interfaces for choosing financial instruments (ordering tickets).

FIG. 8A-C show the method realized with physical ticket machines.

DRAWINGS—REFERENCE NUMBERS

Figure 1:
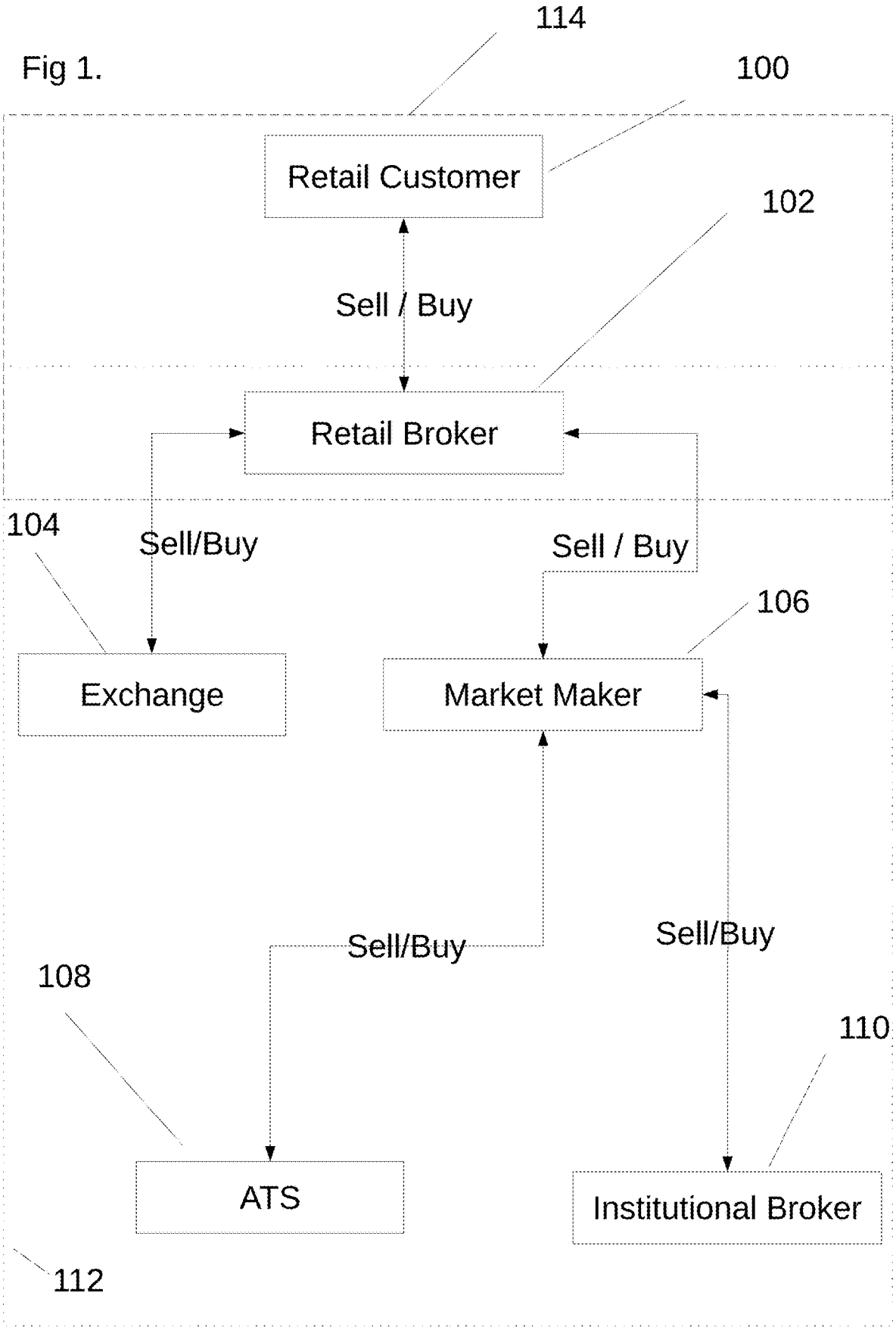
FIG. 1 shows a simplified schematic of a retail customer/retail broker/financial institution interaction.

100 Retail customer
102 Retail broker
104 Exchange
106 Market maker
110 Institutional broker
108 Automated trading system
114 The customer broker interaction section
112 The broker financial markets/industry interaction section
200 Marked number
202 Unmarked number
204 Ticket
208 Financial instrument ticker symbol representing number 12
210 Financial instrument ticker symbol representing number 15
212 View of selected financial instruments
214 Two dimensional matrices
300 Ticket with number and ticker symbols
302 Ticket with ticker symbols only
304 Ticket with symbols in this case Mahjong symbols
308 Ticket with non-changeable selected financial instruments
400 A sequential list of different financial transactions
402 A sequential list of different financial transactions with time spans between the transactions
406 The returned results of the sequential transactions
420 A financial transaction flow chart
422 Modified view of financial instruments
424 Flow chart of financial instruments
426 Time Span
428 Smaller Time Span
500 Timeline
502 Customer Request for a ticket
504 Ticket
506 Filled ticket
508 First transaction process
510 Result of transaction one
512 Second transaction process
514 Result of transaction two
516 Third transaction process
518 Result of transaction three
520 Fourth transaction process
522 Result of transaction four
524 Fifth transaction process
526 Result of transaction five
528 Sixth transaction process
530 Result of transaction six
540 Seventh transaction process
542 Result of transaction seven
544 Result of the ticket
600 Person
602 Internet servers
604 Internet connection
606 Mobile devices
608 Software interface or electronic interface
610 GUI which is displayed in the mobile device
700 Financial intermediaries
704 Technical processes inside the server
706 API
708 Web service
710 Web GUI
712 Web page
718 Payment gateway
720 Step AA customer request of a ticket
722 Step BB ticket generation
724 Customer filled ticket and starts transactions
726 Step XX representing end result
728 Step YY customer requests payout
730 Step ZZ payout of the result to customer
732 Crypto wallet or crypto payment processor
734 Crypto webservice
750 Transaction processing process/sub routine/machine
800 Personal computer
802 Ticket machine
806 Tablet
810 Buyer
812 Ticket
814 Seller
900 Coin insertion device
902 Buttons for customer interaction
904 Credit card reader
906 Mobile payment device
908 Cash insertion device
910 Cash output device
912 Display
920 Printer
930 Ticket scanner

DETAILED DESCRIPTION OF THE DRAWINGS

Description of the Business Method Described in FIGS. 1 to 5

FIG. 1 is explained in the beginning.

Figure 2:
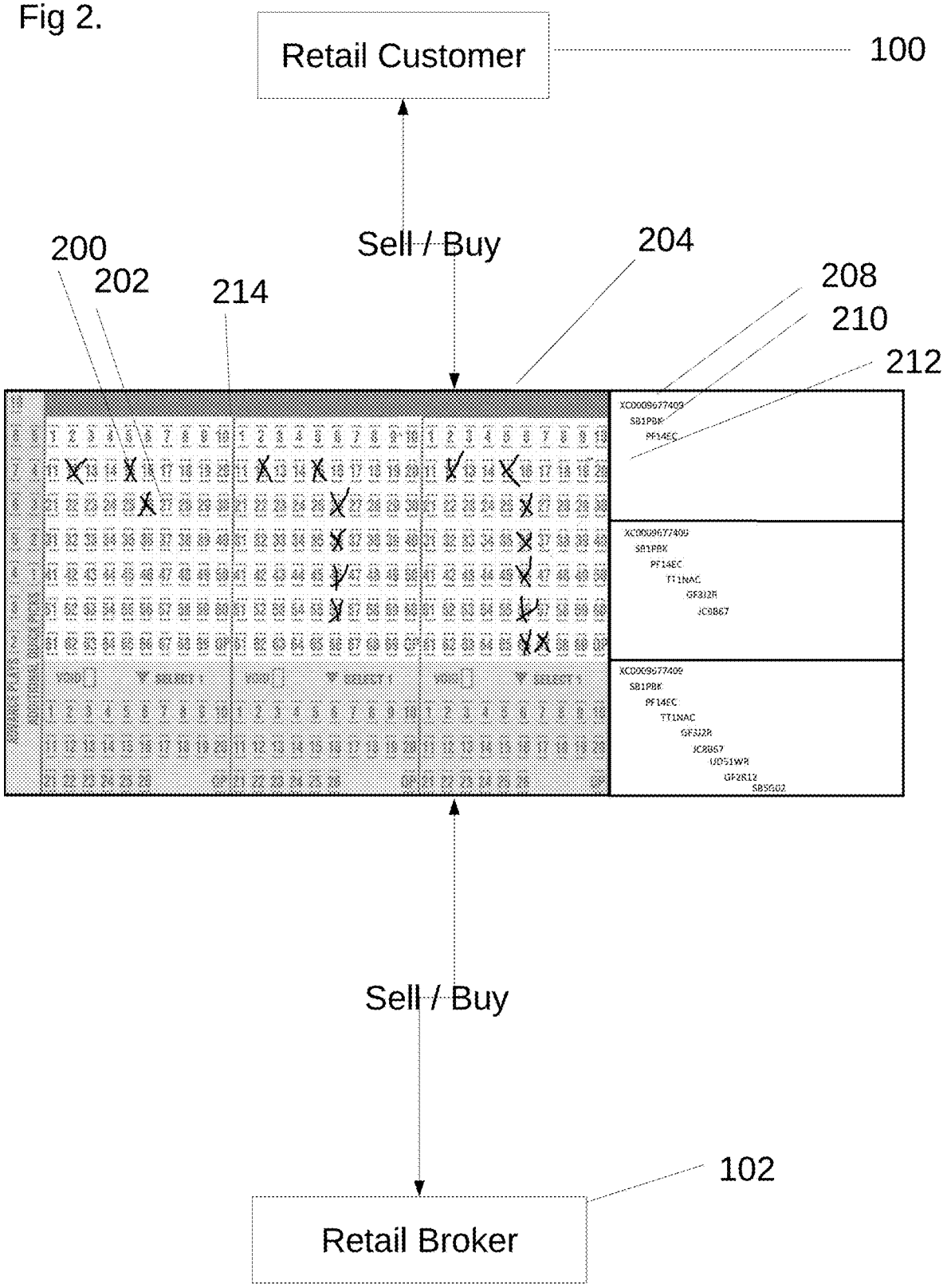
FIG. 2 shows the customer experience of a retail customer regarding this invention.

FIG. 2 shows the customer experience of a retail customer regarding this invention: a ticket (204) is showed between the retail broker (102) and the retail customer (100). It looks similar as a lottery ticket. The ticket (204) is divided into two parts—one part with a two-dimensional matrix (214) containing numbers (202) which can be chosen by marking them by a pen (200), the other part is shown on the right side and contains a view of the selected financial instruments (212). There are three fields with different ticker symbols of financial instrument. The financial instrument with number 12 from the selection field of the matrix (214) represents the financial instrument XC000 . . . (208). Number 15 represents next financial instrument SB1PBK (210) and so on. There are three two-dimensional matrix (214) fields and also three view fields for the concrete chosen financial product (212). Therefore, there is the same number of ticker symbols in the corresponding view field on the right side as numbers marked in the corresponding two-dimensional matrix.

FIG. 3 (A, B, C, D, E) shows five different appearances of Graphical User Interfaces (GUIs) or customer experiences. FIG. 3A shows the ticket described in FIG. 2 (204). FIG. 3B shows another possible two-dimensional matrix in which numbers and ticker symbols are presented in the same selection field (300). FIG. 3C shows tickets with ticker symbol names (302) which are arranged as two-dimensional matrices. FIG. 3D shows a two-dimensional ticket with Mahjong symbols (304). FIG. 3E shows a pre-filled ticket. The numbers on the ticket also represent financial instruments or transactions. This is an example of a ticket with pre-selected and non-changeable financial instruments (308).

Figures 4A, 4B, 4C:
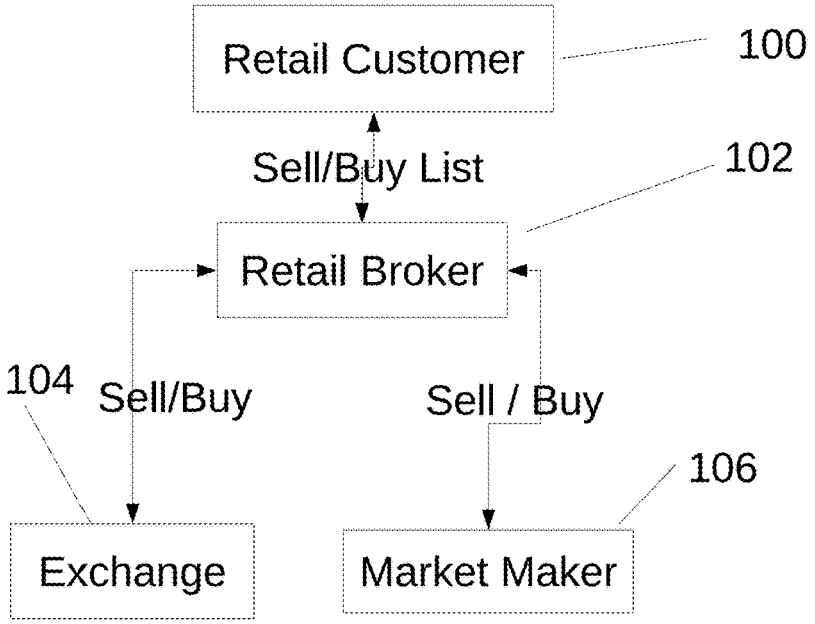
FIG. 4A-D show the several methods of the processing of a financial ordering ticket.

FIG. 4A shows the interactions between a retail broker and a retail customer. The Retail Customer (100) provides a sell/buy list to the retail broker (102) for processing. The retail broker will process this list by doing the trades at an exchange (104) or with other market makers (106).

FIG. 4B shows a sequential list of financial transactions (400). The first row represents the position of the financial transaction, the second row represents the type of transaction. The letters A, B, C, . . . , G are placeholders for financial instruments/transactions.

FIG. 4C shows the sequential processing of a financial transactions list (402). The table (406) lists the sequential order. The graph on top (402) shows the financial transactions and time spans between those them. For example, between financial transaction A and B, there is a time span of 1 day; between financial transaction D and E, there is a time span of 16 hours. The table shows the results of each individual transaction and the total result of all sequential processed transactions—the end result (unit would be either a real or a virtual currency—will be called money units from here on) is listed in column F (end result 4090 Money units). Each column of the table contains the result of all transactions which were done before. Everything starts with 10 money units at first step (1). After transaction A (this means buying a specified financial instrument and holding it for one day and selling it afterwards), the balance is 5 money units. These 5 money units are then used in transaction B for one day and increase the balance to 15 money units. After the complete list of financial transaction is processed, the final result is 4090 money units.

Figure 4D:
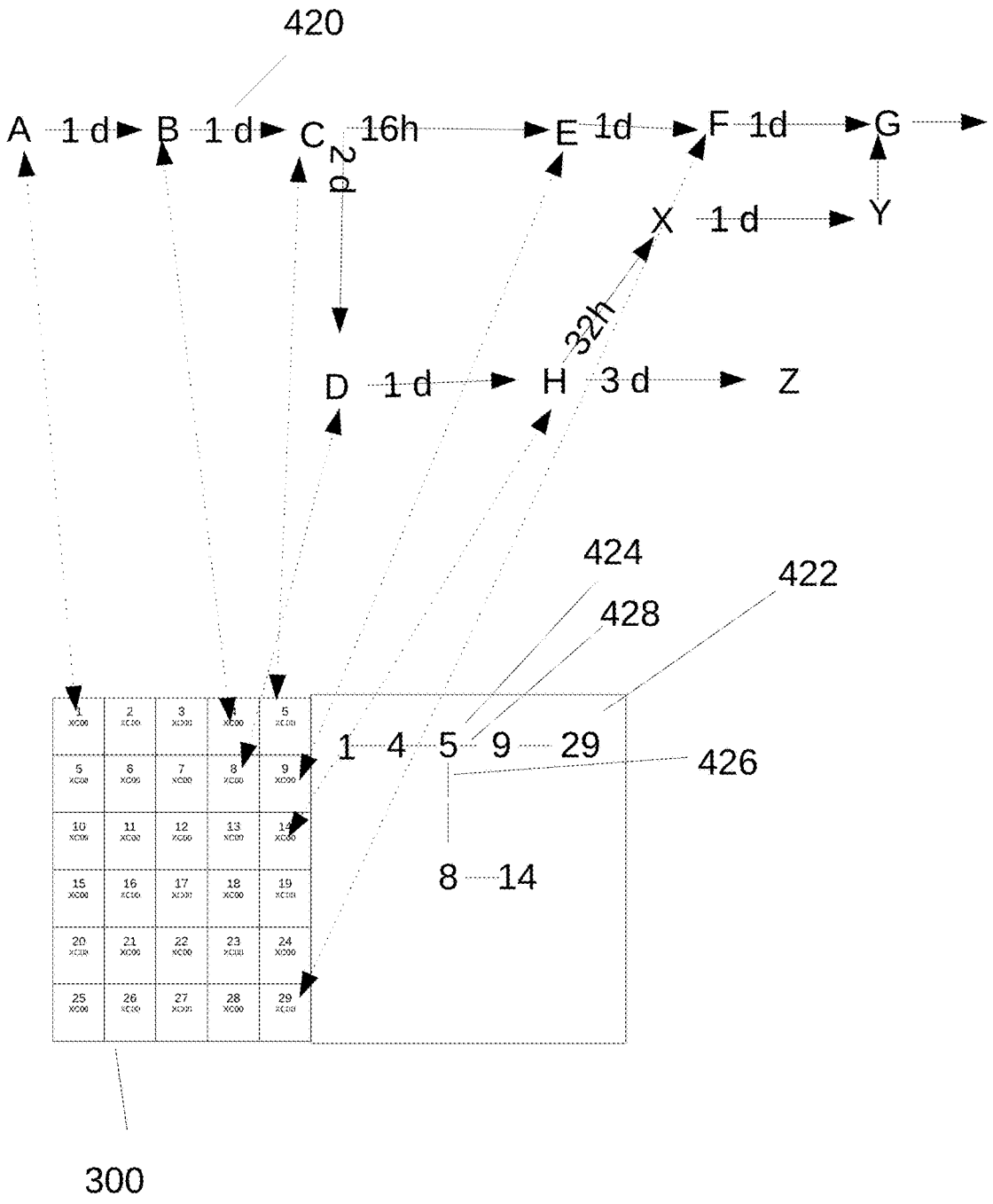

FIG. 4D shows a flowchart of financial transactions (420). In this flow chart some transactions are processed parallelly. For example, the transactions C, D, E and F are processed parallelly. The GUI would have to be changed as shown in FIG. 4D to provide the control of the sequence to the customer (300). A modified view of selected financial instruments (422) is shown by using a flow chart of the selected financial instruments (424). The flow chart consists of numbers of the financial instruments and time spans (426 and 428) between those transactions. The numbers of the financial instruments can be selected in the two-dimensional matrix (300)—each column will be processed at the same time, sequentially from the left to the right—the customer will see the results of his selections in the graphical transaction details view (422). It is also possible to select the time spans between two transactions by arranging the numbers. The distance between two financial transactions represents the duration between them—for example two space units (426) for two days, one space unit (428) for 16 hours.

Figure 5:
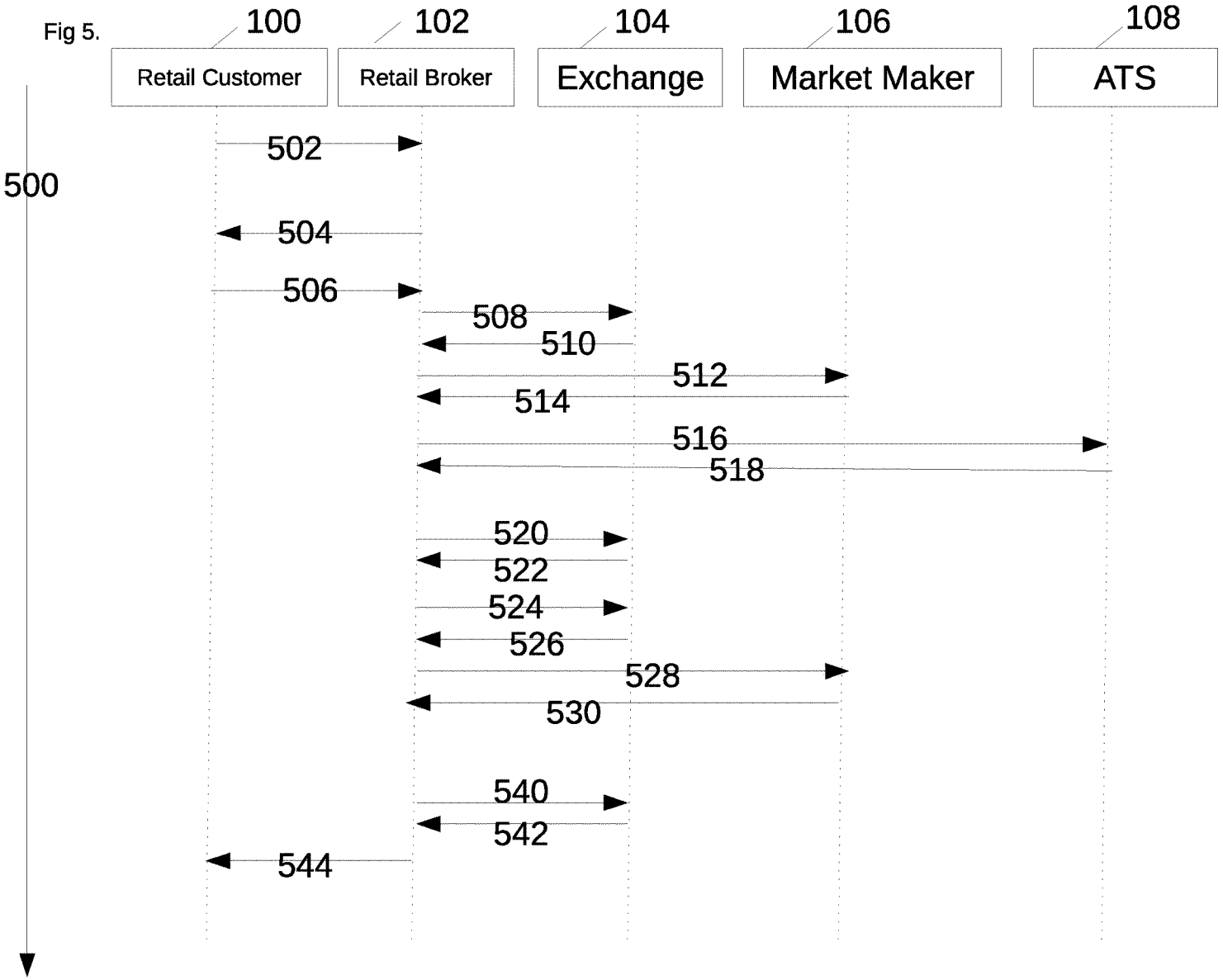
FIG. 5 shows the complete business method sequentially processed.

FIG. 5 shows a typical customer/broker interaction process (as a sequence diagram). The dashed lines represent the five stakeholders involved (customer (100), broker (102), exchange (104), market maker (106) and ATS (108)). The interaction starts as soon as the customer (100) orders (502) a ticket from the broker (102). The broker provides a ticket to the customer (504). This ticket contains information about which financial transactions or financial instruments are currently available for trading (represented in tickets as shown in the FIGS. 2,3 and 4). The customer fills-in the ticket by selecting or arranging the symbols, numbers or ticker symbols (506) and sends it to the broker (102). The broker (102) begins to process the ticket by starting the first transaction process (508). Therefore, the broker (102) uses the exchange (104). After the completion of the first transaction, the result (510) is returned to the broker (102) which then starts the next transaction (512). This will be continued until all transaction from the ticket are processed (542). The overall outcome of the ticket is then reported to the customer (544). There is one transaction (516) which is proceeded by an automated trading system (108)—this means that it is possible to use intelligent orders or transactions. Two other transactions (512 and 528) are done by markets makers.

Operations of FIGS. 1 to 5

The business method works like this: a retail customer (100)—in this example a single individual person—wants to play with financial instruments, orders or financial transactions. He requests a ticket (204) consisting of a two-dimensional matrix (214) were each element of the matrix is representing an available financial instrument or transaction. These elements could also be arranged as a flow chart (420). It is as well possible to select intelligent transactions (they can be processed by automated trading system or robotic traders—for example buying the stock option of Microsoft with the highest risk at a certain date). Additionally, it is possible to use events instead of time spans between two elements. For example, if an exotic option increases its value tremendously, the next element could be started earlier or later.

This ticket with all selected financial products is then processed by the retail broker (100) in a sequentially process (402) or a flow process like (420). In most cases the flow process will be divided into sequentially sub processes. The overall result will then be reported or transferred to the customer (544). It is also possible to use pre-selected tickets (920) with symbols representing financial instruments. The retail customer (100) has just to buy such a ticket in order to use financial instruments.

Figure 6A:
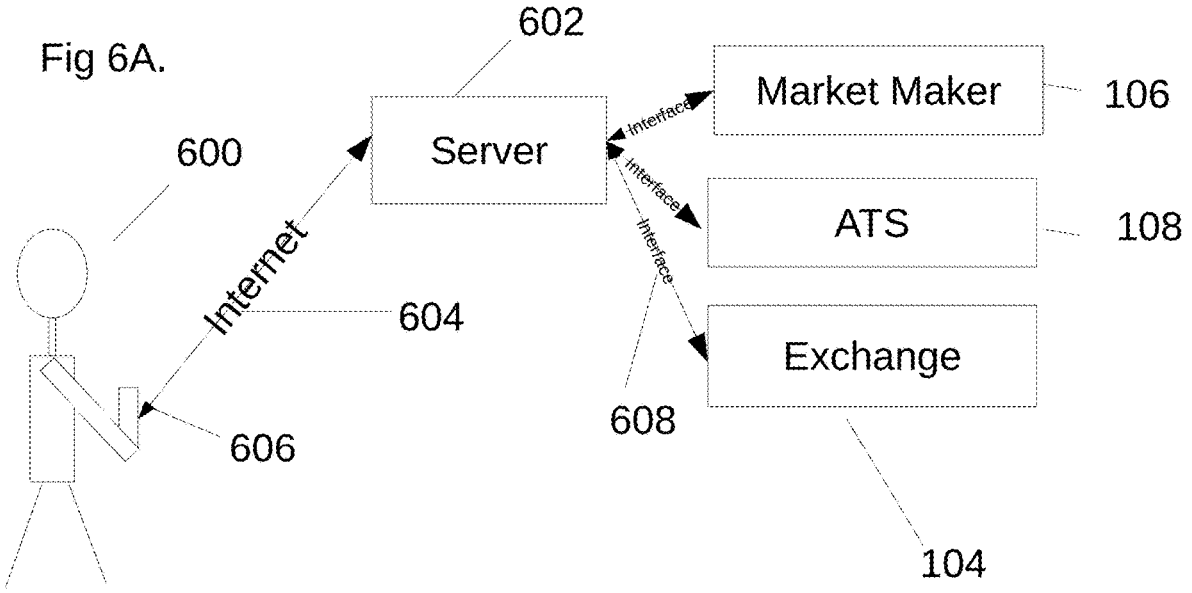
FIG. 6A shows the complete process.
Figure 6B:
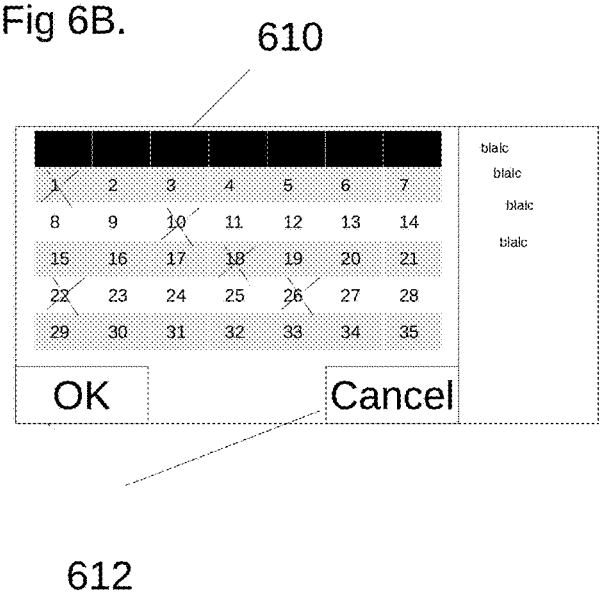
FIG. 6B shows the customer interface which is used in FIG. 6A from a retail customers perspective
Figure 7:
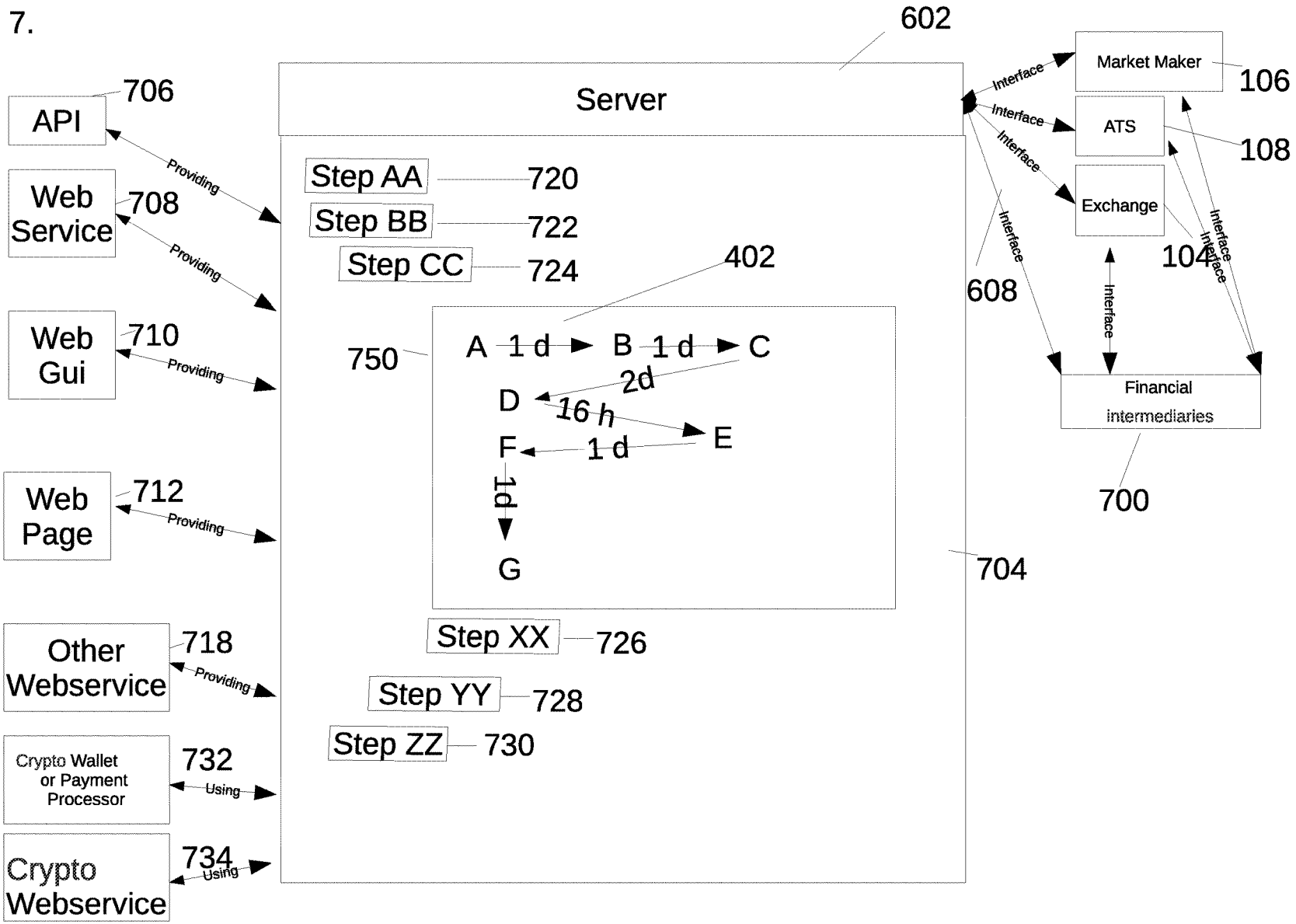
FIG. 7 shows the complete technical implementation of an internet server capable of processing and providing the method to customers.

Description of the Technical Process Described in FIGS. 6 and 7 which Implements the Business Method Described in FIGS. 2 to 5

FIG. 6A shows a customer (600) who is using a mobile device (606) which is connected by the internet (604) to a server (602). This server is also connected using interfaces (608) or other electronic connection to market makers (106), Automated Trading Systems (108) or exchanges (104). FIG. 6B shows the GUI of the web or mobile app which both can be ran on mobile devices (606). The GUI shows a two-dimensional matrix with numbers on the left side and a view of selected financial instruments or transactions on the right side. The technical implementation is described FIG. 3 and FIG. 4D and works like the processes described above. The GUI can be provided by a server using a web page, an app or software running on the mobile device (606).

The following definitions are used in FIG. 7:

API—application programming interface.

Web Service—A more specified API which is a network-based resource that fulfills a specific task.

Web GUI—A graphical user Interface (GUI) in which the customer can interact with the system by a Web browser.

Web Page: A web page is a specified collection of information provided by a webserver and displayed to a customer by a web browser.

Payment gateway: a merchant service provided by an e-commerce application service provider that authorizes credit card or direct payments processing for e-businesses, online retailers, bricks and clicks, or traditional brick and mortar. The payment gateway may be provided by a bank to their customers, but could also be provided by a specialized financial service provider as a separate service, such as a payment service provider.

Crypto Wallet or Payment processor: digital object, that stores the digital credentials for a customers crypto currency holdings and allows the customers to access them. A crypto currency payment processor facilitates the immediate transfer of crypto currency to fiat currency.

FIG. 7 shows an internet server (602). This internet server has interfaces (608) to market makers (106), ATs (108), exchanges (104) and financial intermediaries (700). The server (106) provides functionalities to its clients using APIs (706), web services (708), a Web GUI (710) and a web page (712). The server (602) can use a crypto currency service (734), a crypto currency wallet or payment processor (732) and a payment gateway (718) for receiving and sending FIAT money or crypto money. The figure also shows the processes inside the server (602). First, the customer requests a ticket (720). This is done in step BB (722). After the customer filled-in the ticket and sends it back to the server (724), the server starts processing the ticket as described in FIGS. 4C, 4D and 5 in a transactional sub-process (750). After the sub-process (750) is finished, the end-result is presented to the customer (726). If the customer request the payout (728), it will be processed using the payment gateway (718), the crypto currency web service (734) or the crypto wallet (732).

Operations of FIGS. 6 to 7

FIGS. 6 to 7 is the technical implementation of the business method described in the FIGS. 1 to 5. A customer (600) uses a mobile device (606) (or any other device which is connected to the internet (604)) to interact with the internet server (602). This can be done by opening a web page, by using an app, a client software (606) or by using other gateways or interfaces which will be communicating with the internet server. Regardless the type of the communication, the customer will be shown a GUI on his device which contains a two-dimensional matrix of symbols for selecting financial instruments. The financial products and their processing order can be defined within the GUI. After the selection is done, the customer (600) can send the ticket (as binary data) to the internet server (602). The server will start the processing of the ticket once received and validated it. The processing of the ticket is done as described in FIG. 5. The internet server (602) uses therefore its interfaces to market makers (106), ATs (108), exchanges (104) and financial intermediaries (700). After the ticket has been processed, the customer receives the overall result and can request the payout. The internet server (602) uses payment processors to process the payout to the customer. It is also possible to split the operations of the internet server (602) into different servers.

This means for example that one server creates the web GUI, another one provides the API, one server processes the tickets and uses another server which is communicating with the exchanges and so on.

Figure 8A:
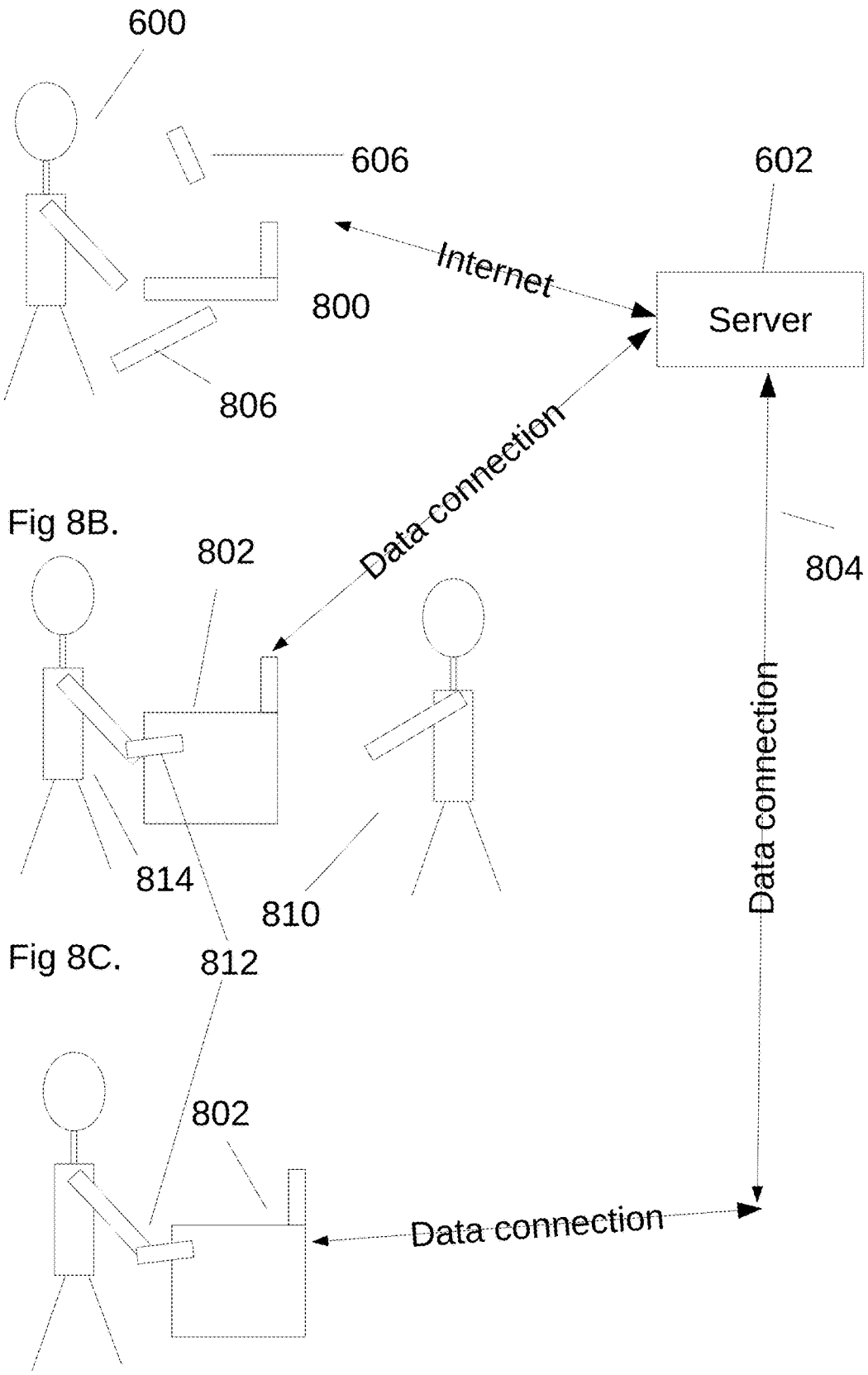
Figure 9:
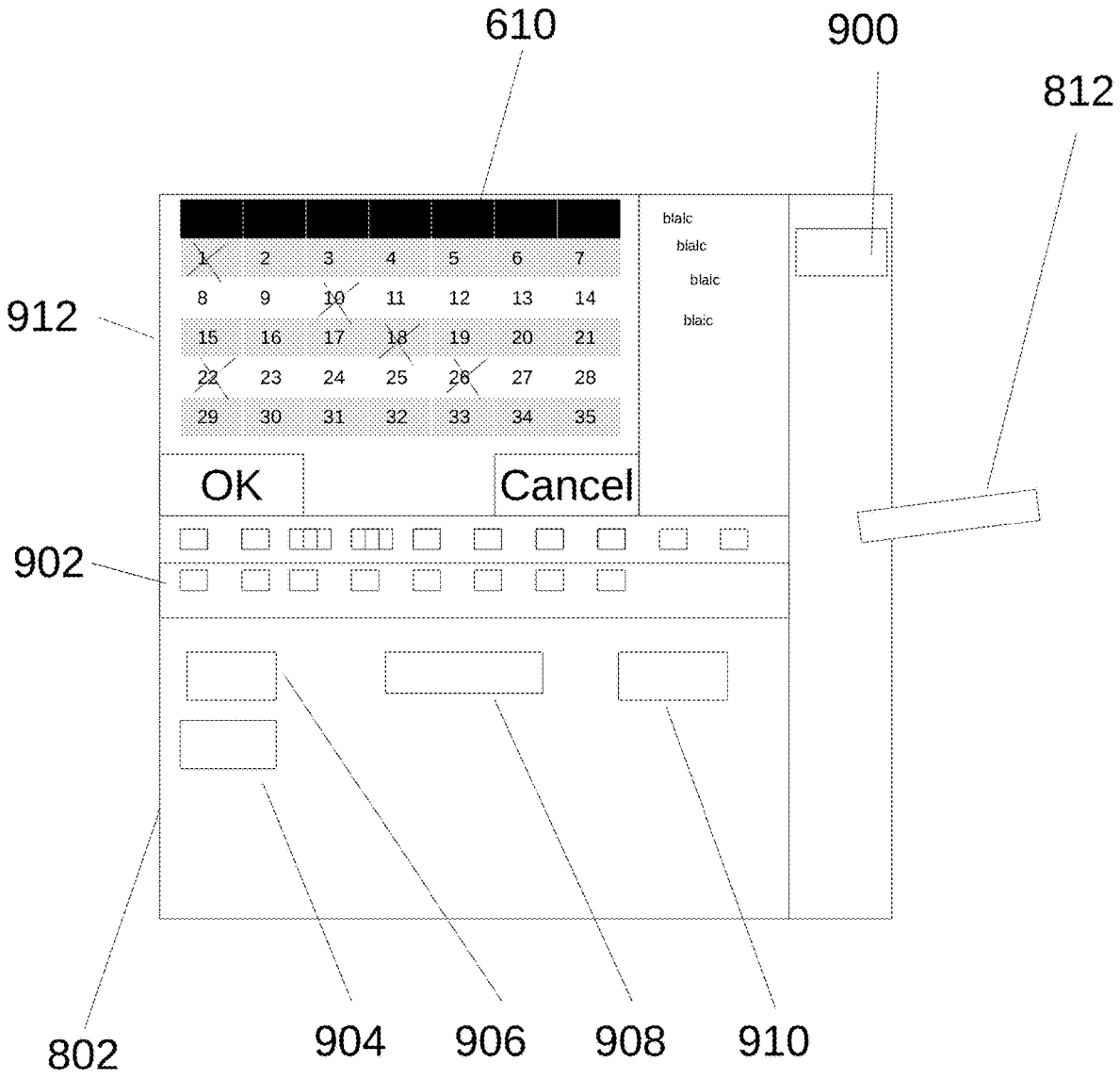
FIG. 9 shows a technical schematic and the customer interface of the physical ticket machine.

Description of the Physical Machine Showed in FIGS. 8 and 9 which Implements the Technical Method Described in the FIGS. 6 and 7:

FIG. 8A shows a customer using a personal computer (800), a mobile device (606) and a tablet PC (806) which are connected to the internet server (602) using the internet.

FIG. 8B shows a customer (814) who orders a ticket which is issued by a merchant using a ticket machine (802) to get a ticket (812). The ticket machine is connected through a data connection to the server (602).

FIG. 8C shows a customer using a ticket machine (802) to buy a ticket (812). The ticket machine is connected to the server (602) through a data connection (804).

FIG. 9 shows a ticket machine (610) for buying or selling tickets (812). Depending on the usage of the machine, not all technical characteristics are necessary. The machine (610) consists of a display (912) showing a two-dimensional matrix for selecting financial instruments or transaction in the same way as filling-in lottery numbers on a sheet of paper. It also consist of buttons/switches (902) or other technical devices for interaction, a credit card reader (904) for processing credit cards, a mobile payment device (906) for other electronic payment methods, a cash insertion device (908) a cash output device (910) for getting the rest of the money back and a printer (920) to get the ticket (812).

Operations of FIGS. 8 to 9

Due to the fact that most people buy their lottery tickets in a supermarket or somewhere else physically and not online with an app, the ticket machine (802) was developed. There are two principal ways how a customer (810) can obtain a ticket (812). The first option is, that the customer can visit a shop in which a seller (814) uses the ticket machine (802) to create the ticket for him. This means the buyer (810) can fill out a ticket in paper (812) and give that ticket to the seller (814) the seller then uses the ticket scanner (930) to scan the ticket and transfer the data to server. The server then processes the ticket as described in FIGS. 6 to 7. The buyer can also buy a pre-filled ticket with random values selected.

Another option is that the customer (810) creates the ticket (812) himself by using a ticket machine (802). The ticket machine (802) has a display (912) which is able to show a two-dimensional matrix as described in FIGS. 3 and 4D for selecting financial instruments or transactions. After the customer has selected own values or has accepted the pre-selected symbols (and after paying), the customer can use the printer (920) to print the ticket (812). The ticket machine will then send ticket to the server for processing it.

The mechanism for processing the ticket are described in figure six and seven. It is also possible that the server (602) is separated into different servers (a group of servers) which each one implementing a part of the functionality of the described internet server (602).

Conclusion, Ramification and Scope

The invention described allows the customer to use complex financial instruments or transaction with an interface which is as easy-to-use as the well-known lottery system.

The main idea on which this invention is based is the experience, that high-risk or speculative financial instruments which can be traded via a retail broker are too abstract for those customers who buy lottery tickets currently. For this reason, a business method has been described in this disclosure which enables financial instruments to be used in the same way as participating in a lottery. An essential part of a lottery is the lottery ticket which either has to be filled-in in by the customer himself or has already been filled-in automatically with random numbers. Most of lotteries use numbers which are arranged in a two-dimensional matrix. However, other characters, images or symbols could also be used. The tickets of this invention look very similar to the old fashioned lottery tickets. Instead of numbers, real financial instruments or transactions are chosen by the customers. They will then be processed by the broker in the real market.

The invented tickets could also be physical objects (like a paper) which are scanned and digitalized by machines. Furthermore, the invented ticket could contain two-dimensional matrices, numbers, symbols, ticker symbols can be used as symbols for selection. The lot can also be preselected.

The following financial instruments could be used with this business method: Derivatives, Forex transactions or intelligent financial instruments or instructions for robotic traders.

A server with a software process was presented which is the technical implementation of this business method. The tasks of this server could also be split into several servers—this is called a server group. This group of servers must consist at least of one server, which is able to communicate with a customer using the internet or other data connection so that the customer is able to select financial instruments. After that, the server processes the selected financial instruments by handing them over to exchanges, market-makers, financial intermediaries or automated trading systems. It is also possible to arrange the symbols in the ticket in a flow chart or diagram to define the desired transaction sequences and delays in-between. The group of servers communicate with the customer by a web page, an API, a web service, a client software or an app. All available internet payment methods could be offered to the customer. Additionally, a physical ticket generation machine was presented, which is able to communicate with the group of servers to create, print and scan tickets for customers. The physical ticket machine works the same way as lottery ticket machines but the printed ticket contains the selected financial instruments or transactions instead of just lucky numbers.

The invention claimed is:

1. A computer-implemented method running on a system for trading financial instruments, comprising:

(A) a device connected to the Internet and comprising at least one display;

(B) the device is communicating via an API, a web page, or another Interface with a group that Includes at least one server;

(C) receiving information about trade-able financial Instruments or transactions;

(D) displaying said Information In the form of a lottery ticket on the display device;

(E) a group of at least one server comprising at least one of the following elements, an API, a Web service, a web GUI, a web page, a web service, and connected by Interfaces, direct or indirect, to an exchange and capable of trading financial instruments or processing financial transactions;

(F) creating a lottery ticket consisting of elements, where at least one element represents a financial Instrument or transaction, or an intelligent transaction;

(G) selecting or accepting financial Instruments or transactions through human interaction with the graphical user interface of the device;

(H) automated sequentially processing the selected financial Instruments or transactions the following way, a computer executes each selected transaction with the current amount of the ticket, the computer waits a specified time, the computer closes the transaction after specified time, the computer computes the result of the transaction and the new amount of the ticket, until all selected transactions are processed or the current amount is empty;

(I) the end-result of all transactions is presented to the customer on the display device.

2. The computer-implemented method of claim 1, which uses derivatives, binary options, knockout options or forex financial instruments, financial transactions.

* * * * *